United States Patent [19]

Richards et al.

[11] Patent Number: 5,033,586

[45] Date of Patent: Jul. 23, 1991

[54] CONSTRUCTION ELEVATOR ASSEMBLY

[75] Inventors: Douglas Richards, Crayford; Robert Anderson, Warrington; Paul Bennett, Wirral, all of England

[73] Assignee: Otis Elevator Company, Farmington, Conn.

[21] Appl. No.: 550,911

[22] Filed: Jul. 11, 1990

[51] Int. Cl.[5] ..... B66B 9/16

[52] U.S. Cl. ..... 187/2; 187/1 R; 187/20

[58] Field of Search ..... 187/2, 1 R, 20

[56] References Cited

U.S. PATENT DOCUMENTS 3,519,101 7/1970 Sieffert .

3,759,349 9/1973 Sieffert ..... 187/2

*Primary Examiner*—Robert P. Olszewski

*Assistant Examiner*—Dean A. Reichard

*Attorney, Agent, or Firm*—William W. Jones

[57] ABSTRACT

The elevator assembly is designed to operate an elevator car in a building under construction. The assembly includes a unitary frame having a machine room module with a machine, traction sheave, deflection sheave, spare cable spools, and a payout sheave module with cable clamps and cable payout sheaves. The frame is periodically shackled to the car and both are craned up several floors in the building as the latter rises. After the frame is set in place, extra cables are fed off of the cable spools via the payout sheaves to reconnect the counterweight to the car.

4 Claims, 5 Drawing Sheets

CONSTRUCTION ELEVATOR ASSEMBLY

TECHNICAL FIELD

This invention relates to a construction elevator system for use in the erection of high-rise buildings. More particularly, this invention relates to an improved construction elevator system which includes a machine room sub-assembly which is periodically craned up through the elevator hoistway of the building as the latter is erected, and which operates an elevator car below it for transport of workers and materials.

BACKGROUND ART

U.S. Pat. No. 3,519,101 granted Jan. 10, 1968 to J. E. Sieffert discloses a construction elevator system which includes a bedplate carrying an electric motor and traction and deflection sheaves for driving elevator car and counterweight cables. Below the bedplate are the car and counterweight assemblies which are driven by the motor and sheaves. The system is used to payout hoistway cable as the building is being erected. Spools of elevator cable, including the hoist and governor ropes, are disposed on the top of the elevator car and cable being fed off of the spools is clamped to the top cross beams of the car. Cables run from the clamps to the traction sheave and therefrom to the counterweight. The construction elevator system is positioned on one of the higher levels of the hoistway during erection of the building. The elevator car is then run up and down in the hoistway to transport men and materials used in construction of the floors below the bedplate portion of the assembly. Meanwhile, erection of floors above the bedplate is continued. Guide rails are installed above the bedplate in the hoistway as the number of floors above the bedplate increases. After a predetermined number of floors has been built above the bedplate, for example six floors, the car is lifted to its highest possible height while the counterweight is lowered to its buffer. The car is then shackled to the bedplate and the bedplate is disconnected from the building beams. Before the car is lifted and shackled to the bedplate, the governor will be lifted to the new upper location and secured thereat. The governor cable will be unclamped and fed off of one of the cable spools on the car. The hoist cables are disconnected from the lowered counterweight. The bedplate and car are then connected to a crane cable and are craned up to the new level by the construction site crane. Once the bedplate is secured in its new location, it is disconnected from the crane cable and the additional hoisting cables are unwound from the spools on the car and are paid down to the counterweight for reattachment thereto. To accomplish this reattachment, the cables are clamped together and the clamp is connected to a hemp rope which is winched or otherwise snubbed to the bedplate. The cable clamps on the car are then released in a preset sequence, and some of the clamps are used as friction clamps as the cables are fed out to the counterweight. When a two to one roping arrangement is used, special measures must be taken to prevent the counterweight dead-end hitch from falling into the hoistway. It will be appreciated that the aforesaid construction elevator is time consuming due to all of the clamps that have to be changed, and does not include a safety brake for emergency application during payout of additional cable. Additionally, much stress is put on the car due to the weight of the cable spools mounted thereon.

DISCLOSURE OF THE INVENTION

This invention relates to an improved construction elevator assembly which is installed in a building being erected and periodically hoisted upwardly in the building as the height of the latter increases. The assembly includes a frame with an upper machine room module and a lower payout sheave module which modules are formed in a single structural frame. Cable drums are journaled at the top of the machine room module. The car is suspended below the payout sheave module. The spare cable is fed from the drums on the machine room module through a set of cable clamps mounted on the payout sheave module adjacent to the payout sheaves. A hand operated brake is also mounted adjacent to the cable clamp assembly. There are two payout sheaves mounted on the payout sheave module of the unit, and the cables are fed from the clamp assembly around the payout sheaves and down to the counterweight assembly. The cables pass around a counterweight sheave and back up to a deflection sheave and thence to a traction sheave mounted on the machine room module of the frame. The cables pass from the traction sheave down to the car and thence back up to a dead hitch on the frame. The counterweight assembly includes a crosshead to which the counterweight sheave is journaled. When the assembly is to be jumped up several floors in the building, the counterweight is lowered into the hoistway pit and the crossbeam/sheave is disconnected from the rest of the counterweight after shackling the car to the frame. The frame and car are then craned up to the new location and set there on retractable cross beams included in the module. This raises the counterweight crossbeam/sheave in the hoistway. When the frame is craned up in the hoistway, the traveling cable is disconnected from the power source in preparation for feeding out additional traveling cable from a spool on a safety platform above the jump frame. When the frame is set in place, power is restored to the controller and machine, and the handbrake is set on the cables. The cable clamps are then loosened to allow lowering of the counterweight crossbeam/sheave back down to the counterweight. To accomplish this, the handbrake is released and cable is paid out from the cable drums via the payout sheaves to the crossbeam/sheave, which is thus able to return to the counterweight in the pit. The crossbeam/sheave is then reattached to the counterweight, the cable clamps are re-tightened, the cable brake released, and the car unshackled from the frame. Both the frame and car engage guide rails which are installed in the hoistway above the location of the assembly as construction of the building continues above the frame. Once the assembly is repositioned, the car is used to ferry men and materials to floors below the assembly.

It is therefore an object of this invention to provide an improved construction elevator assembly for use in on-site erection of high-rise buildings.

It is a further object of this invention to provide an elevator assembly of the character described which is periodically craned upwardly in the building hoistway as the height of the latter increases.

It is an additional object of this invention to provide an elevator assembly of the character described comprising a unitary frame which includes a machine room module carrying cable spools, a machine and traction sheave, and a payout sheave module with payout sheaves for controlling payout of cable from the cable spools.

It is another object of this invention to provide an elevator assembly of the character described wherein a counterweight crossbeam/sheave assembly is used to provide the pull needed to pay the extra cable off of the cable spools.

These and other objects and advantages of the invention will become more readily apparent to those skilled in the art from the following detailed description of a preferred embodiment thereof when taken in conjunction with the accompanying drawings, in which:

BEST MODE FOR CARRYING OUT THE INVENTION

Figure 1:
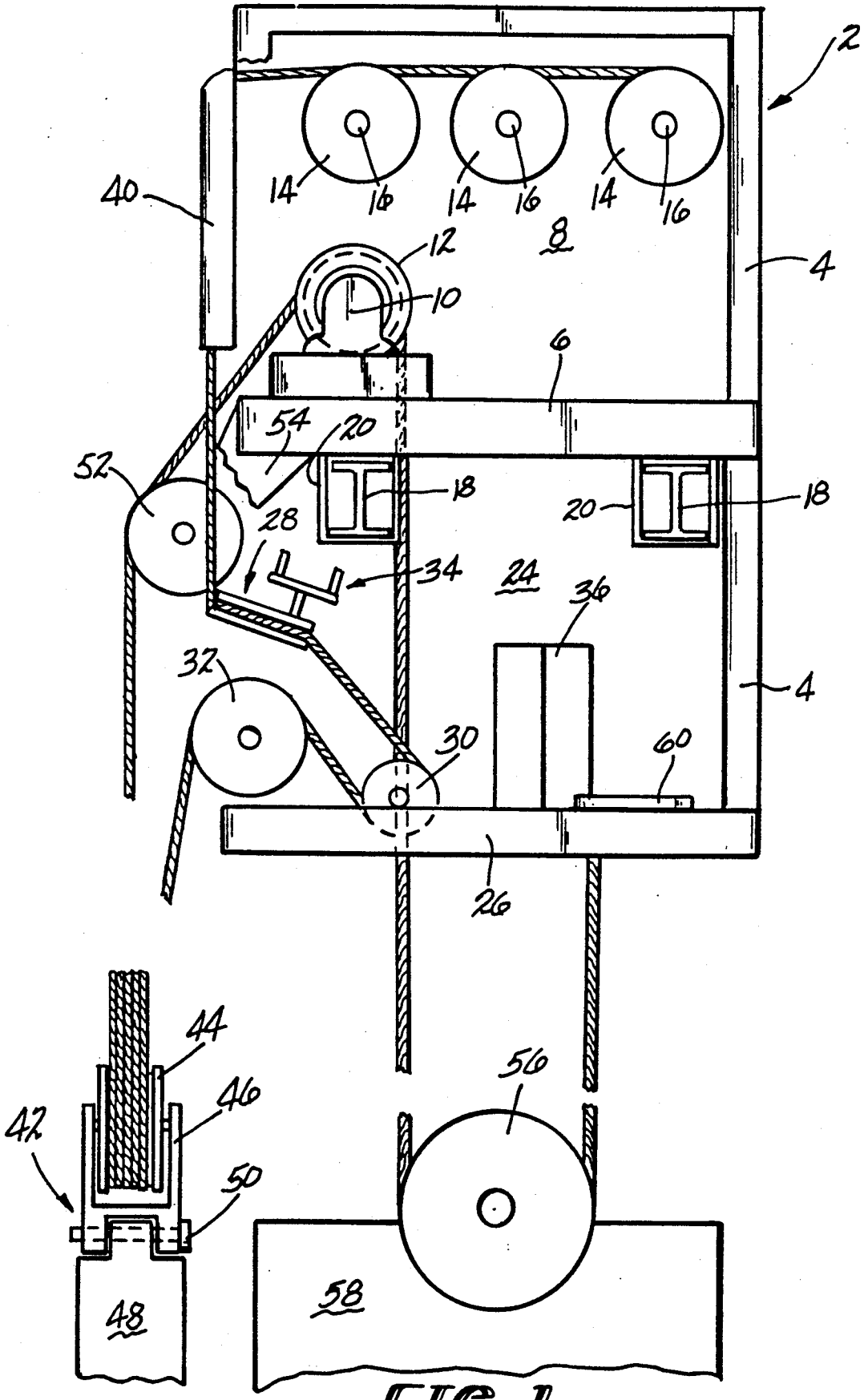
FIG. 1 is a fragmented and somewhat schematic side elevational view of a preferred embodiment of a machine room assembly formed in accordance with this invention, and showing portions of the elevator car and counterweight.
Figure 2:
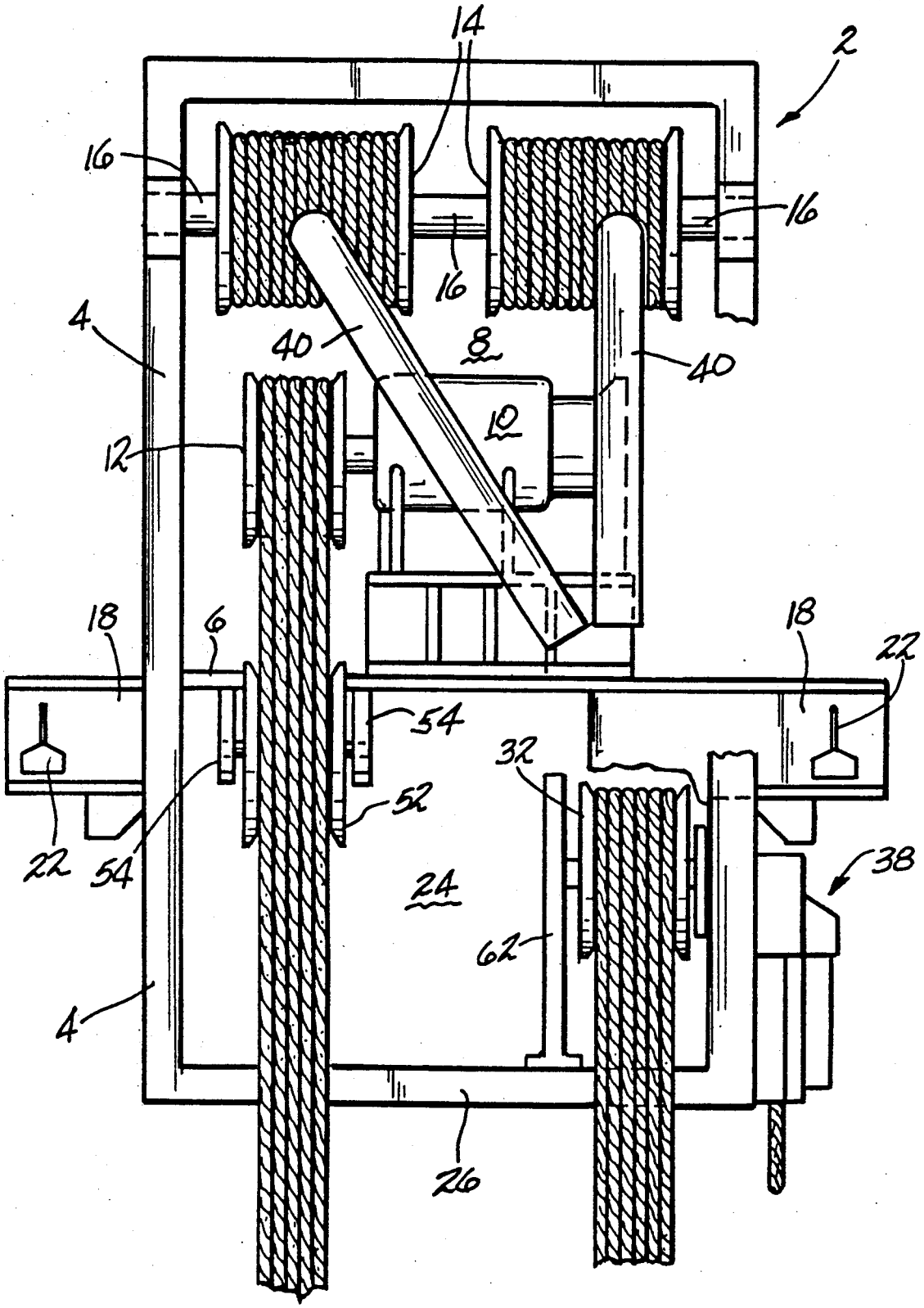
FIG. 2 is a fragmented elevational view of the left hand side of the assembly of FIG. 1.

Referring now to the drawings, the construction elevator assembly, denoted generally by the numeral 2, is shown in FIGS. 1 and 2. The assembly 2 is formed from structural steel beams which form a unitary frame 4 around the upper portion of the assembly 2. The upper half of the assembly 2 has a deck 6 which combines with the frame 4 to form a machine room module 8 part of the assembly 2. It will be understood that the assembly 2 will be closed in to protect the equipment from the weather when in use. An electrically powered traction machine 10 which drives a traction sheave 12 is mounted on the machine room module deck 6, and cable spools 14 are journaled on shafts 16 in the upper region of the machine room module 8. The spools 14 carry excess elevator cable which is periodically payed out when the assembly is craned to a new level during construction of a building. Support beams 18 are telescopingly mounted in channels 20 disposed below the machine room module deck 6. The beams 18 can be pulled out of the channels 20 by handles 22 mounted thereon, as shown in FIG. 2, to support the assembly 2 on the building beams during operation of the assembly 2.

The lower half of the assembly 2 forms a payout sheave module 24 having its own deck 26. A cable clamping assembly 28 is disposed in the sheave module 24, as are two cable spooling sheaves 30 and 32. A hand operated cable brake assembly 34 is associated with the cable clamp assembly 28. A controller 36 is also disposed in the sheave module 24. A governor cable pulley is mounted in a housing 38 outboard of the sheave module 24, as shown in FIG. 2.

Cables are fed from the spools 14 through guide tubes 40 to the cable clamp assembly 28, and thence around the payout sheaves 30 and 32. When the assembly 2 is mounted in place in the building and operating an elevator car, the clamp assembly 28 holds the cables against movement and serves as one dead-end hitch for the elevator cables. The cables run from the payout sheave 32 to the counterweight assembly 42 and around a sheave 44 mounted on the counterweight assembly 42. The sheave 44 is journaled on a crossbeam 46 which is releasably connected to the remainder 48 of the counterweight assembly by a plurality of pins 50. The cables extend upwardly from the counterweight sheave 44 to a deflector sheave 52 and thence to the traction sheave 12. The deflector sheave 52 is mounted on supports 54 secured to the machine module deck 6. The cables extend downwardly from the traction sheave 12 to a sheave 56 mounted on the car assembly 58, and thence back up to a dead-end hitchplate 60 secured to the payout module deck 26. Since the cables are dead hitched at the clamp assembly 28 and at the plate 60, when the assembly 2 is set in place in the building, the machine 10 is able to operate the car 58 in the hoistway below to ferry men and materials to the floors below. Power is supplied to the controller 36, machine 10 and car 58 from the hoistway pit via a traveling cable (not shown).

Figure 4:
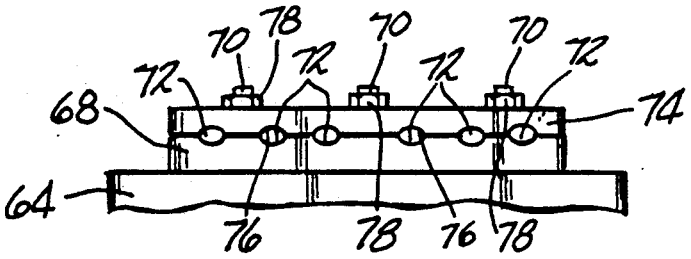
FIG. 4 is a fragmented front elevational view of the cable clamps.
Figure 3:
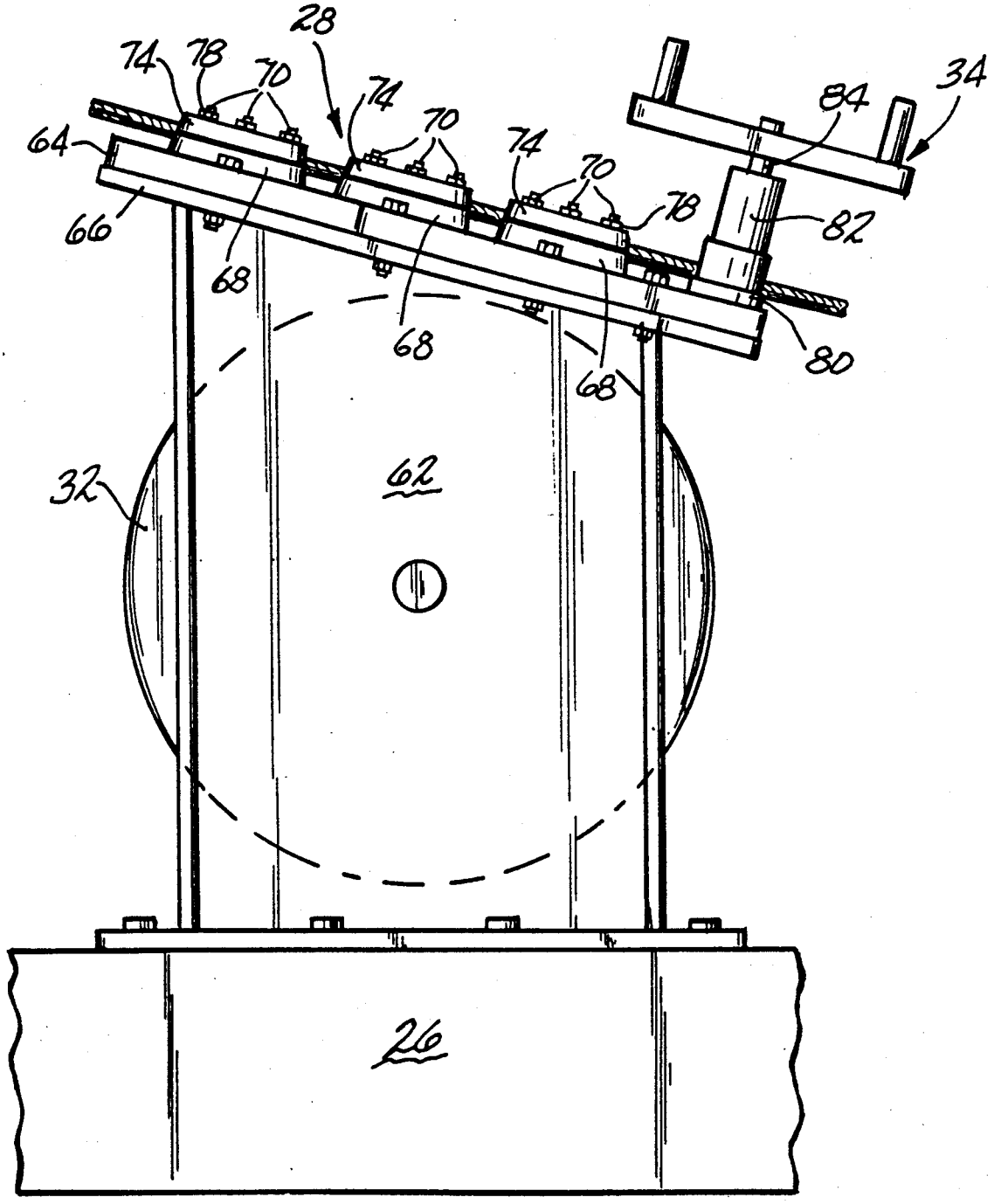
FIG. 3 is a side elevational view of the mounting stand for one of the payout sheaves, and the cable clamps and emergency handbrake mounted thereon.

Referring to FIGS. 3 and 4, details of the clamping assembly 28 are shown. The clamping assembly 28 is mounted on the top of a stand 62 in which the payout sheave 32 is also journaled. The stand 62 is removably bolted to the payout sheave module deck 26. The clamping assembly 28 includes a lower plate 64 which is bolted to lateral flanges 66 on the stand 62. Clamp bases 68 are connected to the plate 64 by bolts 70 which extend through the plate 64 and bases 68. Each clamp base 68 includes grooves 72 through which the cables pass. Upper clamp plates 74 are also mounted on the bolts 70 and overlie the clamp bases 68. The upper clamp plates 74 may also contain grooves 76 for passage of the cables. The cables will be firmly held in place when the upper clamp plates 74 are forced against the clamp bases 68 and intervening cables by tightening the clamp nuts 78 down on the bolts 70.

Figure 5:
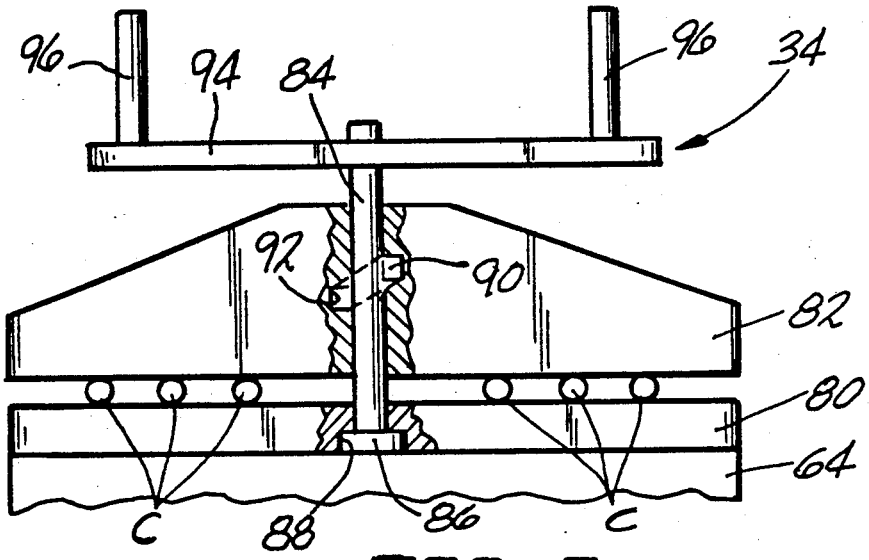
FIG. 5 is a fragmented front elevational view of the hand operated cable brake mounted next to the cable clamps.

The hand operated cable clamp or brake 34 which operates in tandem with the clamping assembly 28 is shown in more detail in FIGS. 3 and 5. The brake 34 includes a base 80 which is mounted on the plate 64 and over which the cables pass. A brake block 82 is mounted above the brake base 80 overlying the cables. A tightening spindle 84 extends through the block 82 and is rotatable in the base 80 by reason of cooperating flange 86 and counterbore 88. The spindle 84 includes a cam lug 90 that disposed in a helical cam track 92 whereby rotation of the spindle 84 will tighten or loosen the brake block 82 on the cables C. A lever 94 with handles 96 is attached to the spindle 84 to allow manual rotation of the latter.

Figure 6:
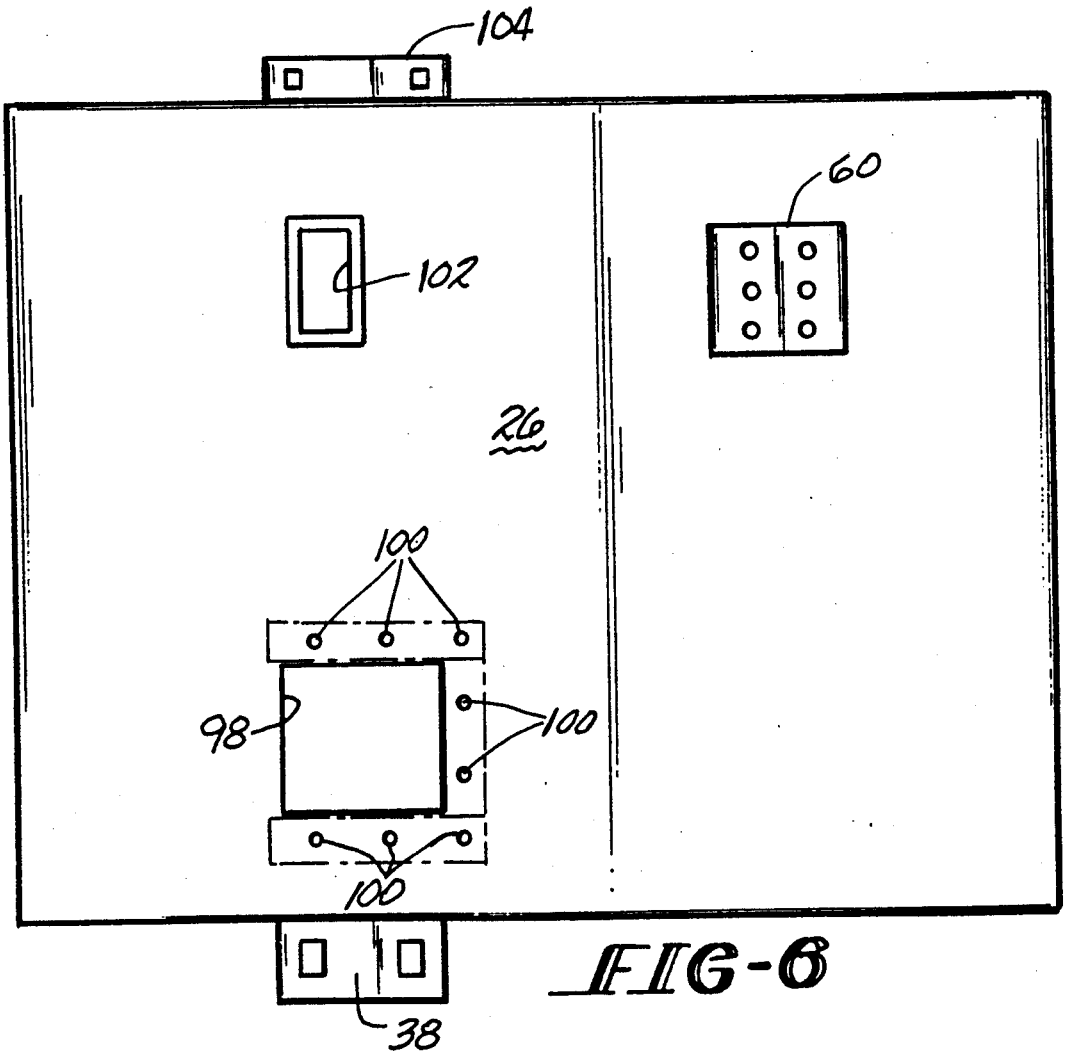
FIG. 6 is a plan view of the deck of the payout sheave level of the machine room module.

Referring now to FIG. 6, there is shown in plan view the payout sheave module deck 26. The deck 26 has an opening 98 therein where the payout sheave 30 is mounted. The stand on which the sheave 30 is journaled is bolted to the deck 26 through holes 100 flanking the opening 98. A second opening 102 for passage of the cables from the traction sheave 12 to the car 58 is provided in the deck 26 opposite the dead-end hitchplate 60. A position sensor tape is mounted on an outboard platform 104 secured to the deck 26. It is noted that the opening 98 provides a locale for bolting a second dead-end hitchplate to the deck after the assembly 2 has been craned to its highest and final position in the building. The second dead-end hitchplate then receives the ends of the cables from the cable clamps 28 to form the second permanent cable hitch on the assembly. When craning of the assembly is finished, the assembly 2 is permanently fixed in place in the building, the payout sheaves 30 and 32, along with the clamps 28 and spools 14 are removed from the assembly 2, and the assembly 2 serves as the permanent machine room for the elevator.

Figure 7:
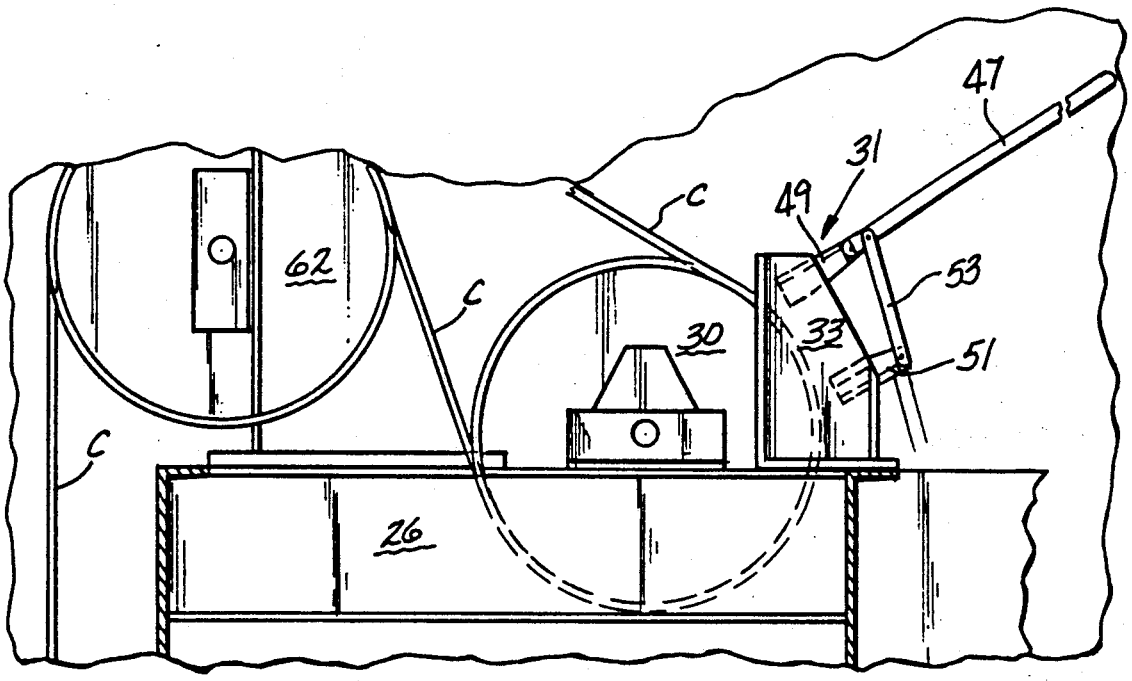
FIG. 7 is a fragmented side elevational view of the spooling sheaves showing the spooling brake.
Figure 8:
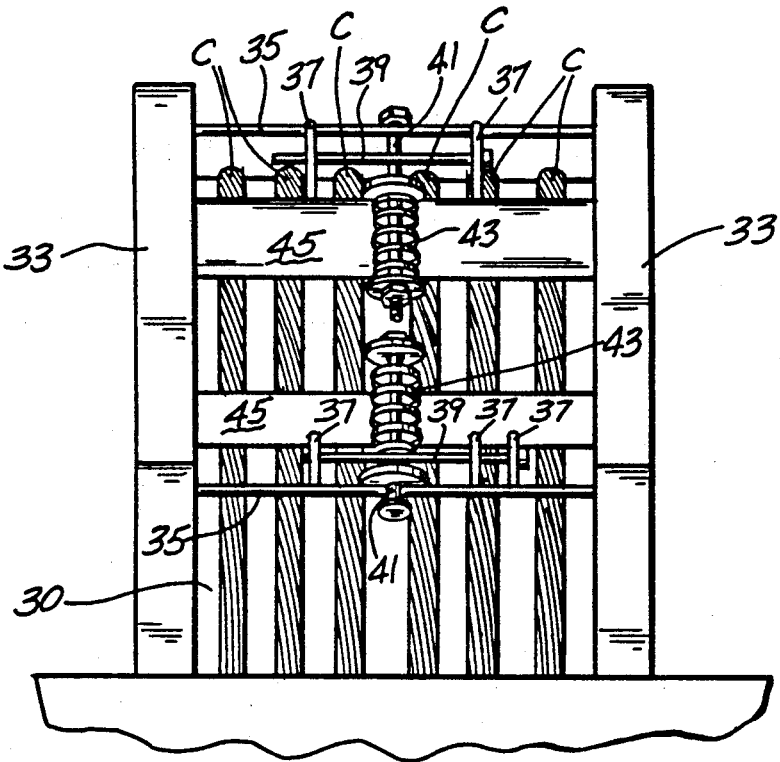
FIG. 8 is an elevational view of the spooling sheave and associated brake as seen from the right hand side of FIG. 7.

As seen in FIGS. 7 and 8 the spooling sheave 30 has associated with it a spooling brake assembly, denoted generally by the numeral 31. The brake assembly 31 is manually operated during out spooling of cable C from the assembly. The brake 31 is mounted on brackets 33 which straddle the sheave 30 and are bolted to the deck 26. Referring to FIG. 8, a pair of rods 35 extend between the brackets 33 and carry brackets 37 in which are mounted pins 39. Spring guides 41 carry coil springs 43 which bias brake shoes 45 against the cables C on the sheave 30. Thus the brake assembly 31 is normally set against the cables C and sheave 30 and must be manually released when cable is fed out from the cable spools. Release of the brake 31 is accomplished with a lever 47 which has two branches 49 and 51 interconnected by a bar 53. The branches 49 and 51 are engaged with the spring guides 41 so that swinging the lever 47 downwardly from the position shown in FIG. 7 will compress the coil springs 43 and pull the brake shoes 45 away from the sheave 30 and cables C, thus allowing cable to be spooled off of the sheave 30.

The assembly 2 and car 58 are craned up or "jumped" in the following manner. When the time comes to elevate the assembly to a new level in the building, the counterweight is run down onto its buffer and the car is lifted to its highest position and then shackled to the assembly 2. It will be noted that while the device is being operated at one level, guide rails are installed above that level for both the counterweight and the car. The assembly 2 also engages the car guide rails when it is lifted up through the hoistway to a new level. After the car has been shackled to assembly 2, the crossbeam 46 is disconnected from the rest of the counterweight 42 by removing the pins 50. Power is then disconnected from the controller 36 to the machine 10. The entire assembly is then lifted sufficiently to allow the support beams 18 to be pushed back into their respective channels 20. The entire assembly is then craned up to the new level of operation. The support beams 18 are then pulled out over building beams, and the device is lowered into place. Power is then restored to the machine 10 and the emergency handbrake 34 is tightened onto the cables. The cable clamps are then released, the handbrake loosened and the spooling brake assembly 31 is lifted whereupon the cables are fed off of the spools 14 and around the payout sheaves 30 and 32. Payout of additional cables allows the counterweight crossbeam 46 to move back down toward the rest of the counterweight assembly until the crossbeam 46 is in position to be reconnected to the weight pack 48 by reinserting the pins 50. During lowering of the crossbeam 46, the spooling brake 31 will be periodically set to control payout of the cable. Once the crossbeam 46 is reconnected to the weight pack 48, the emergency handbrake 34 is retightened and the cable clamps 28 are once again clamped onto the cables. The car 58 is then unshackled from the assembly 2 and the car 58 becomes once more operational. The entire craning procedure is simple and much quicker as compared to the prior art. The payout sheaves 30 and 32 and spooling brake provide a much smoother and more completely controlled payout of cable into the hoistway. As previously noted, when the assembly 2 has reached the highest level of the building to which it will be moved the payout sheaves 30 and 32 can be removed from the assembly 2 and replaced by a dead-end hitchplate which forms the second dead-end hitch for the cables. The assembly 2 is thus left behind in the building to form the permanent machine room for the elevator which it operates.

It will be readily appreciated that the assembly of this invention is of simple construction and provides improved cable payout control as compared to the prior art. The assembly also can be left behind to form the permanent machine room for the elevator car which it operates. This feature is highly advantageous since it eliminates the need to haul a new machine up into the building's machine room, and reconnect all of the cables and the like to the new machine.

Since many changes and variations of the disclosed embodiment of the invention may be made without departing from the inventive concept, it is not intended to limit the invention otherwise than as required by the appended claims.

What is claimed is:

1. A construction elevator assembly comprising:

a) a frame comprising means defining superimposed upper and lower decks;

b) telescoping beams on said frame for temporarily positioning said frame on a floor slab of a building under construction;

c) an electric motor mounted on said upper deck for operating an elevator car suspended beneath said frame;

d) means for mounting a plurality of excess cable spools on said frame above said upper deck;

e) a pair of cable spooling sheaves mounted on said lower deck for spooling cable from said spools to the elevator car and to an elevator counterweight assembly suspended below said frame;

f) means on said frame for delivering cable from said spools to said spooling sheaves; and g) brake means associated with one of said spooling sheaves for controlling payout of excess cable from said spooling sheaves when said assembly is positioned at a new height in the building under construction.

2. The construction elevator assembly of claim 1 further comprising clamping means on said frame for clamping the elevator cables between said means for mounting and said spooling sheaves during periods of operation of the elevator car.

3. The construction elevator of claim 1 further comprising an emergency hand brake on said frame for emergency clamping of the cables during periods of spooling excess cable from the frame to the counterweight assembly.

4. A method of paying out elevator hoist cable in a hoistway during construction of a building which has a movable elevator machine room disposed on a floor in the building and which machine room contains a supply of excess hoist cable, an elevator car suspended from the machine room in the hoistway, and a counterweight assembly including a hoist cable sheave suspended from the machine room in the hoistway, said method comprising the steps of:

a) raising the elevator car up in the hoistway while concurrently lowering the counterweight assembly in the hoistway until the counterweight assembly reaches the bottom of the hoistway;

b) fastening the elevator car to the movable machine room;

c) disconnecting the counterweight hoist cable sheave from the remainder of the counterweight assembly;

d) lifting the machine room, elevator car, and counterweight hoist cable sheave to a higher floor in the building;

e) stabilizing the machine room on the higher floor;

f) paying out cable from the supply thereof on the machine room by lowering the counterweight hoist cable sheave to the remainder of the counterweight assembly and reconnecting the former to the latter; and g) unfastening the elevator car from the machine room.

* * * * *